362-112 SR
10/23/79 XR 4,171,811

United States Patent [19]
Meyer et al.

[11] 4,171,811
[45] Oct. 23, 1979

[54] LIGHT GUN WITH PHOTO DETECTOR AND COUNTER

[75] Inventors: Burton C. Meyer, Downers Grove; Gunars Licitis, Jr., Lombard; Harry Disko, South Barrington, all of Ill.

[73] Assignee: Marvin Glass & Associates, Chicago, Ill.

[21] Appl. No.: 876,409

[22] Filed: Feb. 10, 1978

[51] Int. Cl.[2] ..... F41J 5/02; F41F 27/00
[52] U.S. Cl. ..... 273/101.1; 362/112; 46/192; 46/175 R
[58] Field of Search ..... 273/101.1, DIG. 26, 273/102.1 E; 362/111, 110, 113; 116/124 A, 120; 46/192, 175 R

[56] References Cited

U.S. PATENT DOCUMENTS

| | | | |
|---|---|---|---|
| 997,648 | 7/1911 | Cavanagh et al. | 116/124 A |
| 1,412,586 | 4/1922 | Welch | 273/101.1 |
| 2,668,230 | 2/1954 | Hooker et al. | 273/101.2 |
| 3,271,032 | 9/1966 | Rabinowitz et al. | 273/101.1 |
| 3,454,276 | 7/1969 | Brenkert et al. | 273/102.2 R |
| 3,499,650 | 3/1970 | Lemelson | 273/101.1 |
| 3,508,751 | 4/1970 | Meyer et al. | 273/101.1 |
| 4,090,714 | 5/1978 | Izushi | 273/105.6 |

FOREIGN PATENT DOCUMENTS

| | | | |
|---|---|---|---|
| 1154600 | 11/1956 | France | 273/DIG. 26 |
| 2337872 | 8/1977 | France | 273/101.1 |

*Primary Examiner*—Richard C. Pinkham
*Assistant Examiner*—Lawrence E. Anderson
*Attorney, Agent, or Firm*—Mason, Kilehmainen, Rathburn & Wyss

[57] ABSTRACT

A toy gun or similar device usable with reflective target apparatus utilizes a pulsed light source and a self-contained light detector for detecting light reflected from the target apparatus back to the light detector. The gun includes an audible indicator responsive to the light detector for indicating each time a "hit" is made on the target apparatus, and also includes a resettable counter that provides an indication of the total number of such "hits" achieved in a given time period. The invention also provides a target having a pulsed light source to energize or actuate the light detector.

5 Claims, 9 Drawing Figures

Fig 1
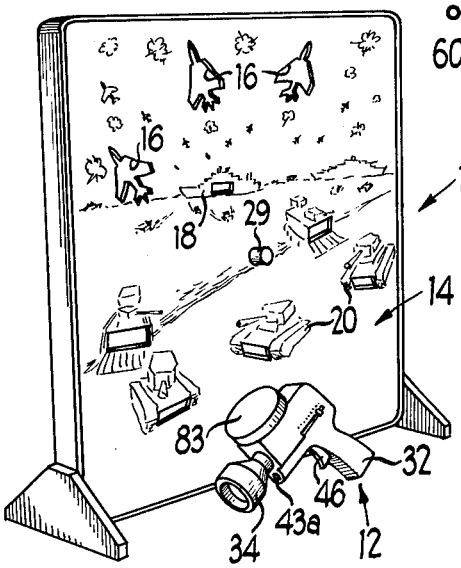
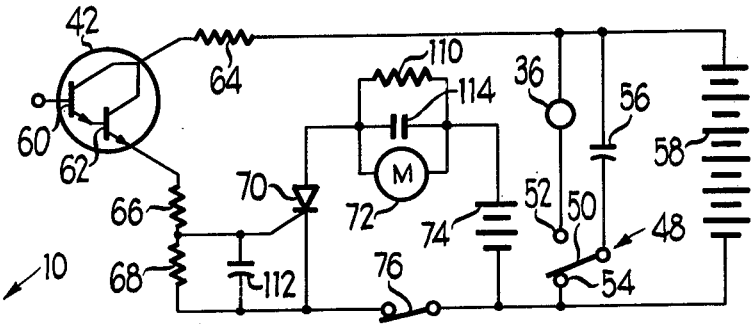
Fig 5
Fig 4
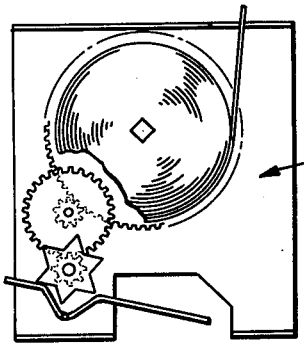
Fig 2
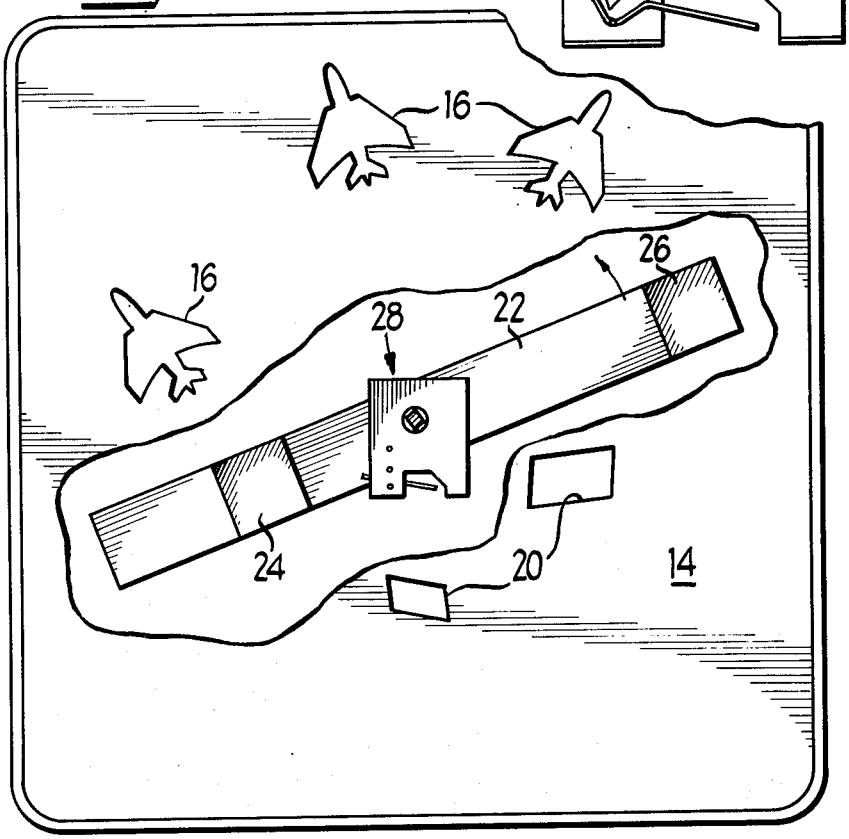
Fig 3
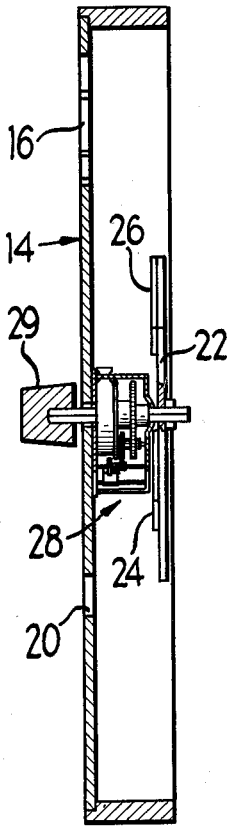

Fig 5
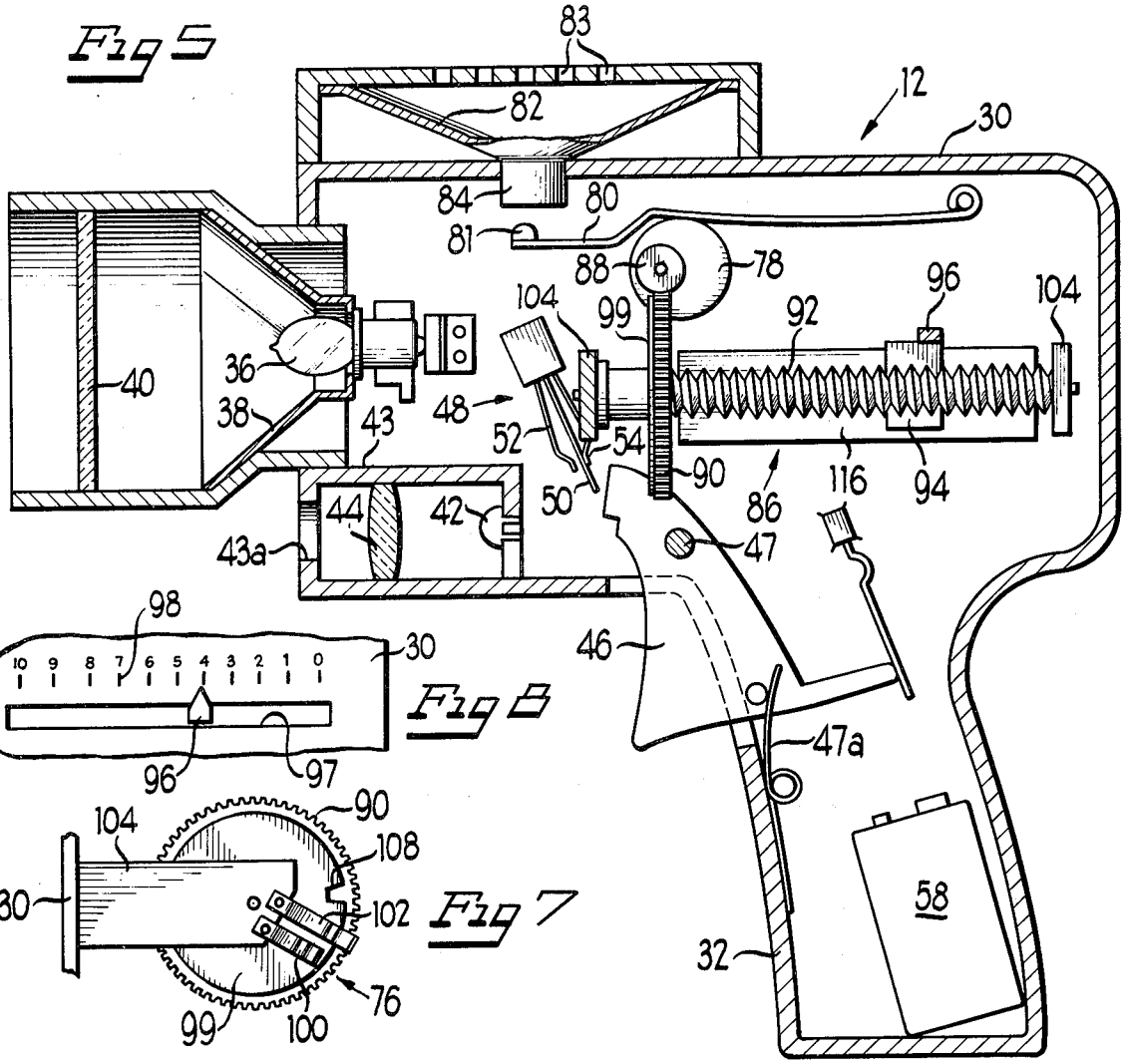
Fig 8
Fig 7
Fig 6
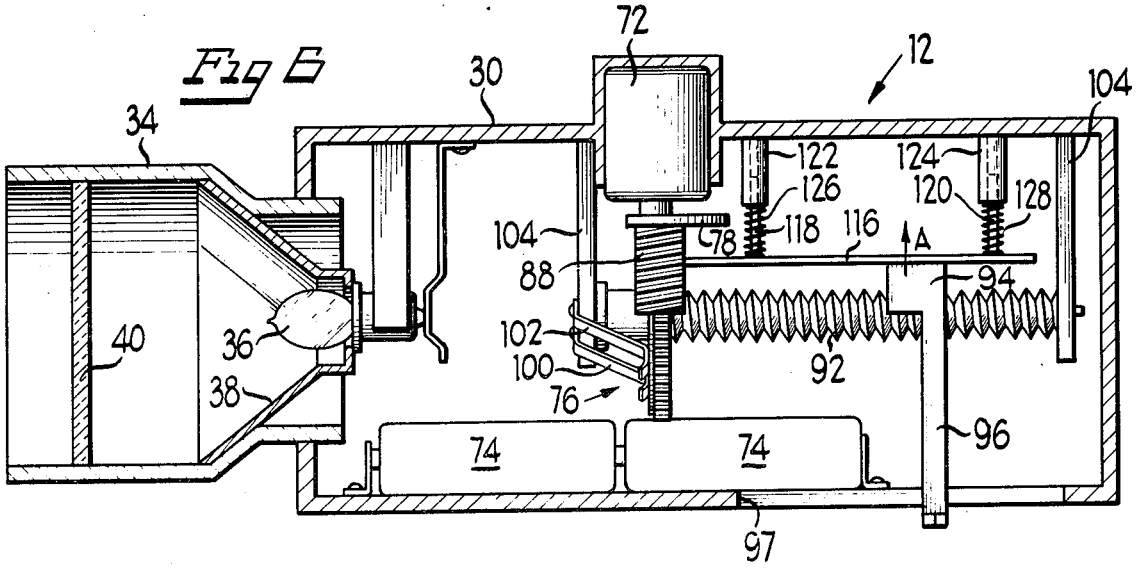

LIGHT GUN WITH PHOTO DETECTOR AND COUNTER

BACKGROUND OF THE INVENTION

1. Field of the Invention

The present invention relates generally to gaming devices, and more particularly to target shooting gaming devices of the type utilizing a light pulse emitting gun, pistol or similar device that includes a light detecting system for detecting light pulses emitted by the pistol and reflected by a reflective target or provided by the target itself.

2. Description of the Prior Art

Several light pulse emitting target games are known in the arcade art. Such games generally employ a pistol, rifle or other gun or the like which emits a pulse of light that is aimed by the player at a light reflective target. If the player's aim is accurate, the light pulse is reflected back from the target to a photocell or other photodetector located within the pistol, rifle or gun. An oscillator driving a loud speaker is coupled to the photodetector, and emits a tone indicative of a "hit" upon detection of the reflected light pulse in order to indicate that the player has scored a "hit".

While such prior art target devices do provide a great deal of amusement, the use of an oscillator and loud speaker to indicate the "hits" tends to increase the cost of the device, and the prior art devices do not contain any apparatus for conveniently counting the number of "hits" made by the player. In such prior art devices, the number of such "hits" is typically recorded manually, and such manual recording tends to reduce the enjoyment of the game and increases the possibility of error and cheating.

SUMMARY OF THE INVENTION

Accordingly, it is an object of the present invention to provide an improved gaming device that overcomes many of the disadvantages of the prior art gaming devices.

It is another object of the present invention to provide an improved low cost light emitting pistol, rifle or gun, or the like, that is suitable for use with light reflective targets to automatically count the number of "hits" made by a player and to provide an electromechanical sounding mechanism for indicating "hits", thus eliminating the need for electronic sounding circuitry and transducers.

BRIEF DESCRIPTION OF THE DRAWINGS

These and other objects and advantages of the present invention will become readily apparent from the following detailed description and attached drawing, wherein:

FIG. 1 is a perspective view of the gaming apparatus showing a light emitting pistol and a typical target apparatus;

FIG. 2 is a cutaway front view of the target apparatus illustrated in FIG. 1 showing how the effect of a moving target may be achieved;

FIG. 3 is a side sectional view of the target apparatus illustrated in FIG. 1;

FIG. 4 is a detailed sectional view of a windup motor suitable for driving the target apparatus illustrated in FIGS. 1-3;

FIGS. 5 and 6 are sectional views of the pistol illustrated in FIG. 1;

FIG. 7 is a detailed view of an electrical contact mechanism affixed to a motor that drives a mechanical sounding mechanism and a "hit" counter;

FIG. 8 is a detailed view of an indicator suitable for counting the total number of "hits" made by a player; and FIG. 9 is a schematic diagram of a circuit that operates the sounding mechanism and "hit" counter.

DETAILED DESCRIPTION OF THE INVENTION

Referring now to the drawing, with particular attention to FIG. 1, there is shown a game generally designated by the reference numeral 10, having a gun which, in this embodiment, comprises a hand-held pistol 12, and a target apparatus 14. The target apparatus 14 has illustrated thereon a wartime scene that includes a plurality of aircraft, each designated by the numeral 16, a ship 18 and several tanks, each designated by the reference numeral 20. In the particular embodiment illustrated, there is provided a rotating arm 22 (FIGS. 2 and 3) having a pair of reflective surfaces 24 and 26 disposed thereon. The arm 22 is rotated by a small motor, in this embodiment a windup motor 28 (FIGS. 2–4). A suitable motor for use as the motor 28 is manufactured by Aladdin Toy Motors, Inc. of Brooklyn, N.Y.; however, any suitable windup or electric motor may be used. A windup knob 29 (FIGS. 1 and 3) is used to wind the motor 28.

The aircraft 16 are formed as openings in the front panel of the target apparatus 14, and similar apertures are made on the drawings of the ship 18 and the tanks 20. Thus as the arm 22 rotates, the reflective areas 24 and 26 are successively moved into alignment with the apertures disposed on the tanks 20 and ship 18 and forming the aircraft 16 in order to provide a moving target effect.

In the illustrated embodiment of the game 10, the player aims the pistol 12 at the aperture behing which one of the reflective areas 24 and 26 is currently positioned. However, if a less elaborate game is desired, stationary reflective areas may be provided on the target apparatus 14 rather than the moving areas 24 and 26.

The gun of the present invention takes the form of a hand-held pistol 12 in the present embodiment; however, the gun may be configured in any desired style or shape, including a pistol, rifle, machinegun, ray gun or any other desired configuration. In the configuration of the present embodiment, the gun 12 has a housing 30 formed in the shape of a pistol. The housing 30 has a handle 32, a barrel 34 and a lightbulb or other light source 36 surrounded by a reflector 38 contained within the barrel 34. When energized, the lightbulb 36 emits a light beam from the barrel 34 through a transparent protective disc or lens 40 mounted within the barrel 34. A photodetector 42 such as, for example, a phototransistor or a photocell is also mounted in the housing 30 within a separate compartment 43 having a forward facing aperture **43*a* aligned with the axis of the barrel 34, and serves to receive light from the bulb 36 that is reflected by a reflective area, such as one of the areas 24 and 26. A lens 44 serves to focus the reflected light onto the photodetector 42 and to reduce the effects of ambient light on the photodetector 42**. Although the preferred form of this invention is disclosed as a reflective system, a target which itself provides a pulsed light source, such as an apertured target moving past a light source, is clearly within the spirit and scope of the present invention. Similarly, the provision of a target device utilizes the novel light detector, "hit" counter and sound producing mechanism of the present invention, falls within the scope of this invention.

A trigger is pivotally mounted by a pin 47 and biased to the position as shown in FIG. 5 by a spring 47*a*. The trigger 46 activates a switch 48 having an armature 50, a normally open contact 52 and a normally closed contact 54. The normally closed contact 54 and the armature 50 are connected in a series circuit with a capacitor 56 (FIG. 9) and a battery 58, which in this embodiment comprises a nine-volt battery mounted in the handle 32 of the pistol 12. Thus, when the trigger 46 is in its normal, undepressed position, the capacitor 56 is connected across the battery 58 and is charged to a voltage equal to the voltage of the battery 58. When the trigger is depressed, the armature 50 is moved from the contact 54 to the contact 52. This opens the circuit between the capacitor 56 and the battery 58, and discharges the capacitor 56 through the lightbulb 36 to cause the lightbulb 36 to emit a momentary flash or pulse of light. The light may be provided by any source, such as a light emitting diode and may or may not be in the visible spectrum. The light from the bulb 36 is formed into a beam by the reflector 38, and if the pistol 12 is accurately aimed at one of the reflective surfaces 24 or 26, the light from the lightbulb 36 will be reflected back toward the lens 44 and focused onto the photodetector.

Although various devices may be used as the photodetector 42, in the present embodiment, the photodetector 42 utilizes a phototransistor 60 connected in a Darlington configuration with a transistor 62. When the phototransistor is illuminated by the light reflected from one of the areas 24 and 26, the phototransistor 60 is rendered conductive and serves to forward bias the transistor 62 which is also rendered conductive for the duration of the reflected light pulse. When the transistor 62 is rendered conductive, current flows from the battery 58 through a resistor 64, the transistor 62 and a pair of resistors 66 and 68. The aforementioned current flow establishes a positive potential at the junction of the resistors 66 and 68 which in turn forward biases the gate of a silicon controlled rectifier 70 and renders the silicon controlled rectifier 70 conductive.

In accordance with an important aspect of the invention, the rendering conductive of the silicon controlled rectifier 70 causes a motor 72 mounting within the gun's housing 30 (FIG. 6) to be energized from a second power source such as a battery 74 via a normally closed switch 76, the operation of which will be more fully described in a subsequent portion of the specification. When the motor 72 is energized, two actions are initiated, the sounding of an audible signal indicating a "hit" and the incrementation of a hit counter by one increment. The two aforementioned actions are accomplished as follows.

In order to generate the "hit" indicative sound, a cam 78, which in this embodiment, is an eccentrically mounted disc, is affixed to the shaft of the motor 72 for rotation therewith. A resiliently biased spring hammer is mounted within the housing 30 and rides on the surface of the cam 78 so that rotation of the cam 78 imparts a reciprocating motion to the spring hammer head portion 81. A diaphragm 82 is mounted below an apertured grill 83 on the top of the housing 30. In this embodiment, the diaphragm is conically shaped and includes a downwardly extending striking member 84, mounted in proximity to the spring hammer head 81. The striking member 84 is positioned closely enough to the hammer 80 to permit the reciprocating spring hammer head 81 to repeatedly strike the striking member 84 when the motor 72 is energized, thereby causing the diaphragm 82 to vibrate at audible frequencies to generate a "hit" indicative tone. Many other types of sound generating devices could be substituted for the one specifically described without departing from the spirit and scope of the present invention.

In addition to generating the hit indicative tone, the motor 78 simultaneously drives a hit counter 86 via a step down gear arrangement such as a worm gear 88 on the motor shaft and a driven gear 90. Although the hit counter 86 may take several various electronic or mechanical forms, in the present embodiment the hit counter 86 comprises a lead screw member 92 rotatably mounted within the housing and a nut or follower 94 that rides on the lead screw 92. A pointer 96 (FIGS. 5, 6 and 8) is affixed to the nut 94 and extends through a slot 97 in the housing adjacent a scale 98 which indicates the correct number of hits. In the embodiment shown, the scale 98 provides marks identified by the numerals 1–10 and the spacing between adjacent marks on the scale 98 is so constructed to equal the pitch of the lead screw, i.e., the spacing between adjacent ones of the threads 92 thereof, so that the pointer 96 is advanced one increment along the scale 98 for each revolution of the lead screw 92. Thus, the lead screw 92 is rotated by the motor 78 one complete revolution each time a "hit" is detected. Rotation of the lead screw 92 by one revolution is accomplished by the switch 76, illustrated schematically in FIG. 9 and mechanically in FIGS. 6 and 7.

One of the characteristics of a silicon controlled rectifier, such as the silicon controlled rectifier 70, is that once triggered, a silicon controlled rectifier remains conductive until the current flowing between the anode and cathod electrodes of the silicon controlled rectifier is reduced to zero, irrespective of the signal applied to the gate. Thus, in the circuit of FIG. 9, once the silicon controlled rectifier 70 is rendered conductive by the detection of a reflected light pulse by the photodetector 42, current continues to flow from the battery 74 through the motor 72 for as long as the switch 76 remains closed regardless of whether or not light is being detected by the detector 42. Thus, once energized, the motor 72 will continue to rotate for as long as the switch 76 remains closed. During this time, the spring hammer head 81 will repeatedly strike the striking member 84 of the diaphragm 82 and cause the hit indicative sound to be emitted.

However, according to another important aspect of the present invention, the switch 76 is controlled by the rotation of the gear 90. Although the switch 76 may be a separate switch that could be controlled by a cam or similar device mounted for rotation with the gear 90, it has been found advantageous, from a standpoint of simplicity, to utilize a pair of contact members 100 and 102 (FIG. 7) which make contact with a conductive disc 99 (FIG. 6) mounted for rotation with the gear 90, to provide the switching function.

In the embodiment illustrated in FIG. 7, the contact members 100 and 102 are conveniently affixed to a front lead screw support member or flange 104 on the housing wall which serves to rotatably support the front end of the lead screw 92. The contact members 100 and 102 are positioned so that the contact member 102 makes contact with the conductive disc 99 generally at the outer periphery thereof and the contact member 100 makes contact at an inner point on the conductive disc 99, which may be formed integrally with the gear 90 or formed from a separate piece of conductive material and attached to the gear 90. Thus, a normally closed conductive path is provided between the contact members 100 and 102.

The disc 99 is also provided with a radially extending slot 108 of sufficient width, greater than the width of the contact 102, formed in the periphery thereof which serves to interrupt the conductive path between the contact members 100 and 102 whenever the slot 108 passes beneath one of the contact members, such as the outer contact member 102 as shown in FIG. 7. Such an interruption occurs once for each revolution of the gear 90, and when such an interruption occurs, the flow of current through the silicon controlled rectifier 70 is momentarily interrupted, thereby causing the silicon controlled rectifier 70 to be rendered nonconductive and the motor 72 to be de-energized. Thus, for each detected hit, the motor 78 causes the gear 90 and the screw 92 to rotate exactly one revolution in order to advance the pointer 96 one increment along the scale 98.

It should be noted that after the silicon controlled rectifier 70 is rendered nonconductive and the motor de-energized, the switch 76 must be returned to a closed position in order that the motor may again be energized upon the detection of the next pulse by the detector 42. This is accomplished by the momentum of the motor 78 which causes the shaft of the motor 78 to continue turning for a sufficient time period after the motor has been deenergized to permit the slot 108 to be moved out from under the contact 102, thus re-establishing a conductive path between the contacts 100 and 102. The length of time that the shaft of the motor 72 continues to rotate is determined by the value of a resistor 110 (FIG. 9) which serves as a dynamic braking load for the motor 72. Capacitors 112 and 114 serve as transient suppressing capacitors, with the capacitor 112 serving primarily to prevent false triggering of the silicon controlled rectifier 70, and the capacitor 114 serving to suppress the inductive transients generated by the motor 72.

In order for the hit counter 86 to be useful, it must be readily resettable. Therefore, in accordance with yet another important aspect of the present invention, the nut 94 is designed so that it surrounds or engages only approximately one-half of the circumference of the lead screw 92 to permit the nut 94 to be disengaged from the lead screw 92 upon lateral movement of the nut 94 in the direction of arrow A in FIG. 6. In the normal mode of operation, the nut 94, which may be a simple sheet material nut, is maintained in contact with the lead screw 92 by a support plate 116 that is supported within the housing 30 by a pair of pins 118 and 120 that slidingly engage a pair of tubular members 122 and 124 extending from the housing 30. A pair of biasing springs 126 and 128 serve to bias the plate 116 into engagement with the nut 94, thus biasing the nut 94 into engagement with the lead screw 92. When so positioned, the nut 94 will cause the pointer 96 to advance as the screw member 92 rotates and the nut 94 slides along the surface of the plate 116. Resetting of the pointer to zero, or to any desired count, is achieved simply by manually depressing the pointer inwardly into the housing against the force of the biasing springs 126 and 128. This disengages the nut 94 from the threads of the lead screw 92 and the pointer 96 may be moved to any desired setting by a simple sliding motion.

If the pistol 12 is used with a target which provides the light pulses toward the pistol 12, the lightbulb 38 and associated circuitry would not be needed. If, on the other hand, the sounding mechanism and counter were mounted on the target, the light detector portion and related circuitry would not be necessary on the pistol 12.

Obviously, many modifications and variations of the present invention are possible in light of the above teachings. Thus, it is to be understood that, within the scope of the appended claims, the invention may be practiced otherwise than as specifically described above.

We claim:

1. A gaming device, comprising:

a hand manipulatable housing;

means for emitting a beam of light on said housing;

a trigger for rendering said light beam emitting means operative to thereby produce a light pulse;

light detecting means on said housing and oriented in a manner to receive light pulses reflected by reflective objects illuminated by said light beam;

electro-mechanical means responsive to said light pulse indicative signals for providing an audible and quantitative indication of the detection of said reflected light pulses, said means including a rotary electric motor for rotating a cam and worm gear, a hammer engaging said cam for movement thereby during energization of said motor, a speaker cone assembly in the path of movement of said hammer for producing said audible indication, said worm gear engaging a drive gear formed on a control shaft mounted within the housing, said drive gear including contact means for maintaining said motor energized for a predetermined period of rotation of said control shaft; and counting means responsive to the rotation of said control shaft for providing an indication of the number of reflected light pulses received by said light detecting means.

2. The gaming device of claim 1 wherein said counting means includes a threaded portion on said control shaft and a complementary threaded follower for engaging said threaded portion, said follower having a pointer disposed thereon for indicating said count.

3. A gaming device as recited in claim 2 wherein said follower engages generally one-half the circumference of said threaded portion and is resiliently biased against said threaded portion.

4. A gaming device as recited in claim 3 wherein said follower is slidingly mounted with respect to and axially movable along said threaded member upon rotation of said control shaft.

5. A gaming device as recited in claim 4 wherein said pointer is rigidly mounted to said follower to permit said follower to be disengaged from said threaded portion when said pointer is manually depressed against the force of said resilient biasing means to permit said pointer to be manually reset.

* * * * *